United States Patent [19]

Varlet

[11] Patent Number: 4,917,156

[45] Date of Patent: Apr. 17, 1990

[54] DEVICE FOR FILLING AN AEROSOL RECEPTACLE WITH GAS THROUGH A PUMP CRIMPED ON THE RECEPTACLE

[75] Inventor: Jean-Pierre Varlet, Le Neubourg, France

[73] Assignee: Valois, Le Neubourg, France

[21] Appl. No.: 276,770

[22] Filed: Nov. 28, 1988

[30] Foreign Application Priority Data

Nov. 30, 1987 [FR] France ..... 87 16594

[51] Int. Cl.[4] ..... B65B 31/10

[52] U.S. Cl. ..... 141/20; 141/47; 141/263; 141/269; 141/291; 141/346; 141/352; 141/383

[58] Field of Search ..... 141/3, 20, 46, 47, 49, 141/263, 264, 269, 291, 292, 293, 294, 346, 348, 349, 350, 351, 352, 354, 383, 386

[56] References Cited

U.S. PATENT DOCUMENTS

| | | | |
|---|---|---|---|
| 3,103,956 | 9/1963 | Focht | 141/350 X |
| 3,179,132 | 4/1965 | Focht | 141/350 X |
| 3,605,791 | 9/1971 | Troadec | 141/20 X |
| 4,298,040 | 11/1981 | Pohan | 141/269 X |
| 4,441,634 | 4/1984 | Meshberg | 141/20 X |
| 4,463,784 | 8/1984 | Butcher et al. | 141/20 |

FOREIGN PATENT DOCUMENTS

| | | | |
|---|---|---|---|
| 719965 | 10/1965 | Canada | 141/20 |

*Primary Examiner*—Ernest G. Cusick
*Attorney, Agent, or Firm*—Joseph S. Iandiorio

[57] ABSTRACT

The device (102) is intended to inject a gas under pressure into an aerosol receptacle (100) through a pump or spray head crimped onto said receptacle. The purpose of the gas is to prevent air from penetrating into the aerosol receptacle as the liquid contained therein is sprayed out. The device is actuated by the pressure of the filling gas and it includes a damping system for ensuring uniform operation.

5 Claims, 7 Drawing Sheets

DEVICE FOR FILLING AN AEROSOL RECEPTACLE WITH GAS THROUGH A PUMP CRIMPED ON THE RECEPTACLE

The present invention relates to a device for filling an aerosol receptacle with gas through a pump which is crimped on said aerosol receptacle.

BACKGROUND OF THE INVENTION

Pumps are used for spraying various types of liquid substance (with the pump plus receptacle assembly commonly be called an atomizer or a sprayer) and typical substances include perfume and medicines. The volume emptied by spraying out the substance is ordinarily filled with air. However, certain substances must avoid coming into contact with air. In which case a gas, e.g. nitrogen, is injected under pressure into the receptacle with the receptacle being deliberately not completely filled with substance for spraying in order to leave space to receive the gas. As the substance is sprayed out, the nitrogen expands to occupy the volume emptied. It is difficult to inject the nitrogen after the receptacle has been filled with liquid and the pump has been crimped onto the receptacle.

The invention relates more particularly to injecting a gas (nitrogen) into receptacles fitted with precompression pumps of the type described in U.S. Pat. No. 4 025 046 or in corresponding French patents Nos. 2 305 241 and 2 314 772.

SUMMARY OF THE INVENTION

The present invention provides a device for filling an aerosol can with gas, the aerosol can being of the type in which spraying is controlled by means of a pump crimped to the can, said gas being injected into the can via the pump, said device being movable between a high or rest position and a low or operating position, wherein said device comprises a socket provided for fitting over the pump when the device is in its low position, said socket including an internal cylinder in which a piston is slidably mounted, said piston carrying a retractable needle capable of extending downwardly in order to penetrate into the pump and open a passage for gas filling by pushing back a closure valve member, said cylinder including: a high admission orifice; a low exhaust orifice; a gas transfer channel between the admission orifice and the needle outlet; and means for limiting the exhaust flow rate from the cylinder in order to damp the down stroke of the piston when gas under pressure arrives at the admission orifice.

Advantageously, the device further includes a sleeve surrounding the socket and supporting it in such a manner as to enable limited relative sliding motion in one direction only (up) of the socket within the sleeve, said motion serving to open the exhaust from the cylinder and to put it into communication with the atmosphere via a flow rate limiter.

According to another advantageous feature, the relative motion of the socket relative to the sleeve causes the cylinder to move and turns on the flow of filler gas.

According to another advantageous feature, the motion of the socket relative to the sleeve serves to switch off the down stroke of the device as a whole.

According to another advantageous feature, the motion of the socket relative to the sleeve causes the pump to be clamped in the bottom portion of the socket.

According to another advantageous feature, clamping is provided by laterally disposed fingers capable of projecting radially inwardly within the socket and by the sleeve possessing an internal cam surface capable of exerting thrust on the outer ends of the fingers.

The filler head device can be mounted on any type of gas filling machine for valves or pumps, without requiring the machine to be specially modified.

BRIEF DESCRIPTION OF THE DRAWINGS

An embodiment of the invention is described by way of example with reference to the accompanying drawings, in which.

MORE DETAILED DESCRIPTION

Figure 1:
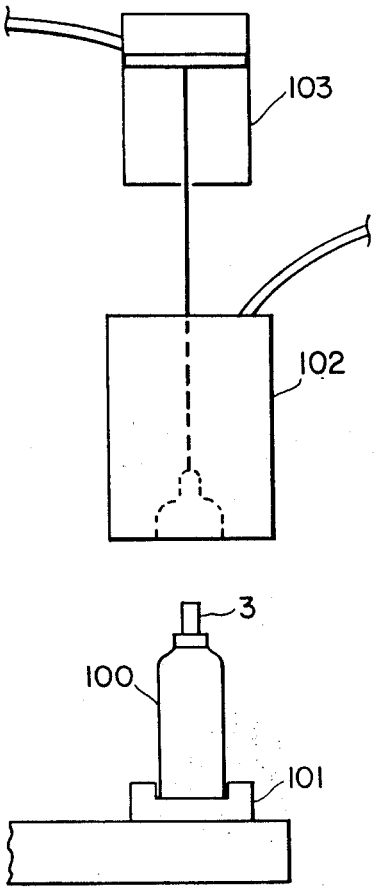
FIG. 1 is a diagrammatic elevation view showing the relative positions of a device in accordance with the invention and a pump-actuated sprayer prior to the beginning of the filling operation.

The device of the invention is intended to be mounted on any filler machine of the PAMASOL, COSTER, AEROFILL, etc., types. These machines include a filling position 101 on which a can 100 is placed with the can being filled with liquid up to a certain level (e.g. two-thirds full) in order to leave a volume available to receive the gas that is to be injected. A pump 3 is crimped to the neck of the can or flask. The device 102 of the invention is fixed, for example, to an actuator 103 so as to be capable of being lowered towards the can. When in its low position, the device clamps onto the sprayer and injects gas into it. When the operation is over, the actuator 103 lifts the device, and then the receptacle filled with gas is replaced by a receptacle having no gas.

The device comprises a socket 1 terminated at its bottom end by a hat-shaped hollow 2 or centering device provided for the purpose of placing over the spray head and its receptacle filled with liquid, and for centering them. The device is intended to be mounted on a machine above the receptacle 100 so as to move up and down with the hat-shaped hollow centering the spray head at the end of its down stroke. The inside of the socket 1 has a cylinder 4 in which a piston 5 is free to slide. The piston is urged upwardly by a spring 6. At the top end of the cylinder there is an admission orifice 7 for admitting a fluid under pressure in order to push the piston 5 against the force of the spring 6. A needle 8 extends downwardly from the piston and is capable of sliding out in sealed manner through a bottom axial hole 9. Sealing is provided by an appropriate sealing ring 31. The sealing provides two functions: firstly it prevents the gas injected into the pump from returning into the cylinder and disturbing the motion of the piston, and secondly it serves to damp the down stroke of the piston by means explained in greater detail below. By extending downwardly as the piston itself moves down, the needle penetrates into a pump for the purpose of pushing back the non-return valve 105 of the pump. An exhaust orifice 10 is provided near the bottom of the cylinder in order to allow the fluid contained in the cylinder to escape when the piston moves downwardly. By virtue of the sealing ring 31, the orifice 10 throttles the escaping fluid, thereby damping the motion of the piston 5.

A channel 11 is provided in the wall of the cylinder. The top end of this channel opens out into the admission orifice 7 and its bottom end opens out via an outlet 12 disposed at the outlet from the orifice through which the needle 8 passes, downstream from the sealing ring 31. Thus, when a fluid under pressure is applied via the admission orifice 7 to urge the piston 5 downwardly, the same fluid passes in parallel along the channel 11 in order to reach the outlet of the needle 8, i.e. the inlet to the pump 3, but is prevented from moving back into the cylinder 4 by virtue of the sealing ring 31.

In order to clamp the piston of the pump 3 in place, fingers 13 are angularly distributed around the circumference of the bottom portion of the socket 1 and are disposed to slide radially in respective horizontal cylinders 14. The fingers 13 are disposed at a level corresponding to the top portion of the pump when the socket 1 is in place thereon for a filling operation. The cylinders open out into the centering device 2 via orifices 15. Each finger has a pointed tip 16 at its orifice end and an enlarged head 17 at its opposite end which is urged radially outwardly by a spring 18. Each finger head 17 is associated with a ball 19 which is used for urging the finger radially inwardly. In the rest position, the tips of the fingers do not project into the centering device, thereby enabling the centering device to be put freely into place on a pump 3. Thereafter, by pressing against the balls, the tips are urged into the centering device where they engage the piston of the pump.

The socket 1 is surrounded by a sleeve 20 and an adapter 30. The socket can thus slide relative to the sleeve and occupy a bottom or rest position and a top or working position. The socket 1 is urged towards its bottom position by a spring 21 as is the cylinder by a spring 22. The upwards motion of the socket inside the sleeve against said springs serves to perform four functions:

(1) Causing fluid under pressure to be admitted into the cylinder

The admission orifice 7 for admitting fluid into the cylinder 4 is extended by an admission duct 23. The adaptor 30 has its top end connected to the body of a non-return valve 29 which surrounds said duct 23 and which includes a normally closed valve member 24. This valve body is connected to the actuator of the machine and serves as the inlet duct for gas under pressure. When the socket 1 rises in the sleeve, pushes back the cylinder, and slightly compresses the sealing ring 106, the admission duct raises the valve member, thereby opening a passage for the fluid under pressure.

(2) Releasing the cylinder exhaust

A duct 25 opens out to the inside of the adapter via an orifice 26 facing the exhaust 10 from the cylinder when the socket is in its high position. Thus, when the socket is in its low position the exhaust is closed and the piston 5 is prevented from moving down freely. A flow rate limiter or throttle 27 is provided at the other end of the duct 25 in order to control the rate of exhaust so as to brake the rate at which the piston moves down, and thereby avoid any shock (i.e. it provides damping).

(3) Acting on the pump-clamping balls

Figure 5:
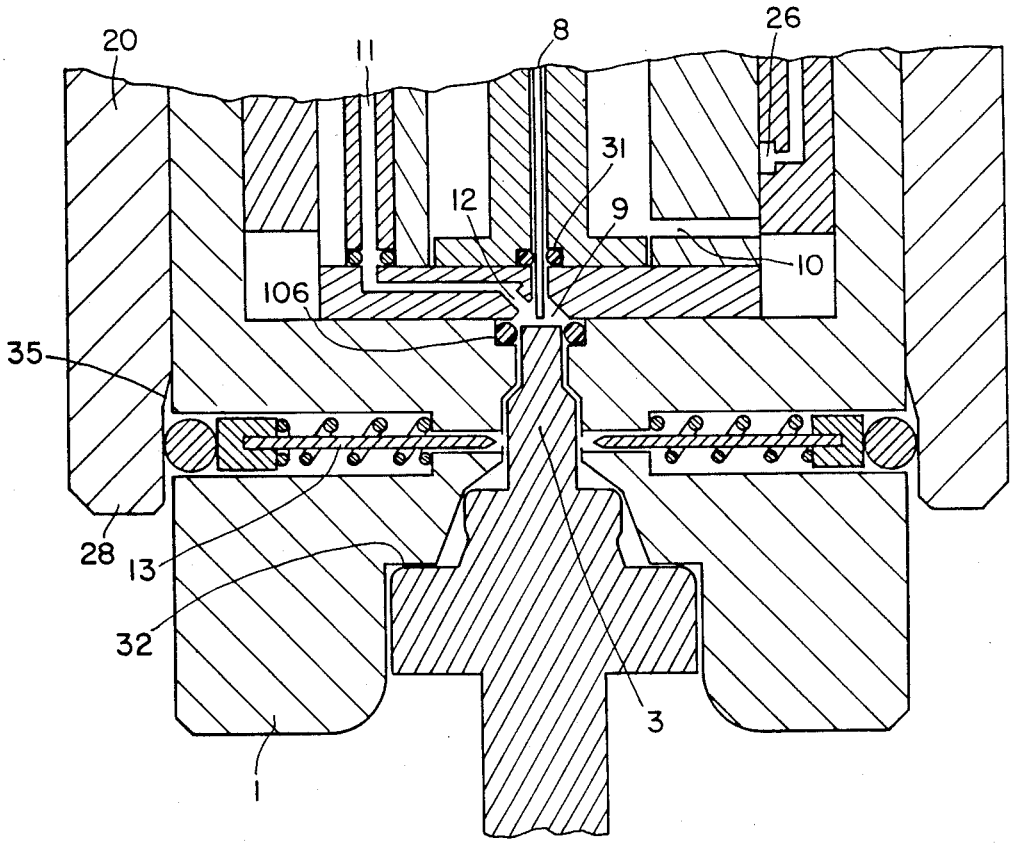
FIG. 5 is a detail section through the above example showing stage No. 1, i.e. centering the sprayer in the socket.
Figure 6:
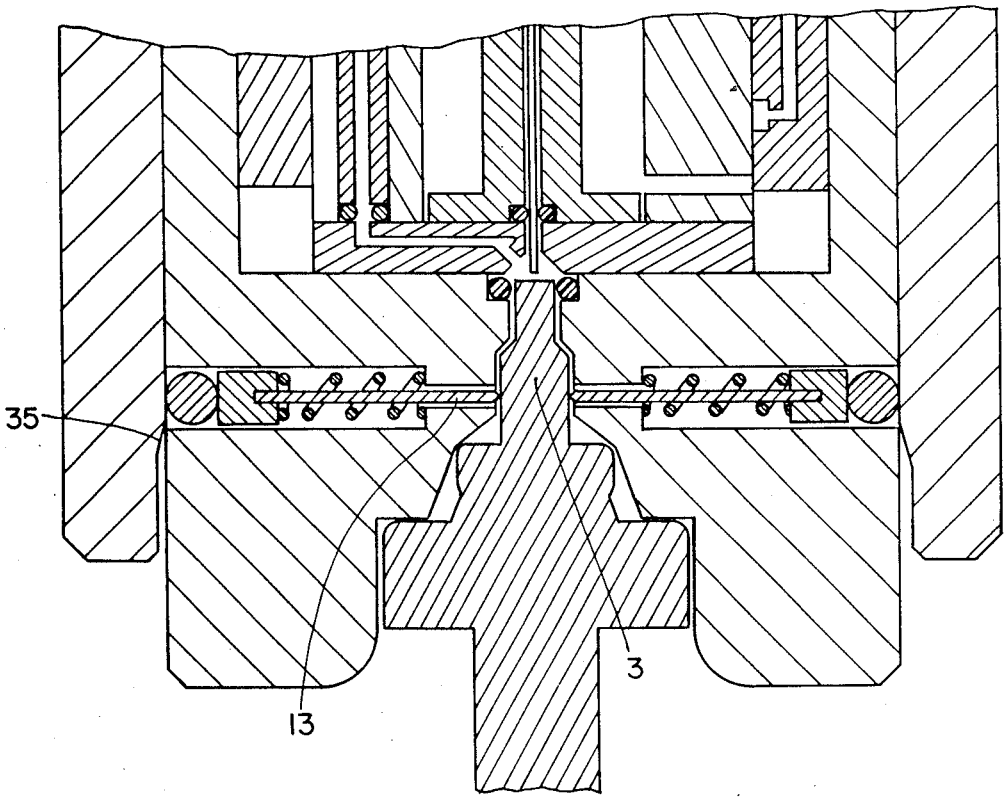
FIG. 6 is a view similar to FIG. 5 showing stage No. 2, i.e. clamping to the pump piston by means of cam-operated fingers or pins.

The sleeve 20 includes a downwardly directed skirt 28 whose inside wall includes a cam surface 35. When the socket is in its low position, a larger diameter, thinner walled portion of the edge of the skirt 28 is level with the balls 19 and serves to prevent them from escaping while nevertheless leaving the tips 16 of the fingers 13 in a retracted position (see FIG. 5). When the socket is in its high position, the smaller inside diameter of a thicker walled portion of the skirt engages the balls, thereby causing the tips 16 to penetrate into the centering device and thus clamp the piston of the pump in place if a pump is to be found in the socket (see FIG. 6).

(4) Stopping actuator down stroke

When the device moves down to occupy the filling position, the sleeve carries the socket and they both move down together. When the shoulder 32 of the centering device 2 comes into abutment on the pump 3, then the socket stops moving down. However the sleeve continues to move down until it reaches its low position, corresponding to the bottom dead center position of the actuator. When the device is mounted on a machine, the valve body 24 is fixed to the actuator 103. The socket is supported by the sleeve via a shoulder 33 resting on a step 34 inside the sleeve. The socket is pressed against this step by the springs 21 and 22.

Figure 3:
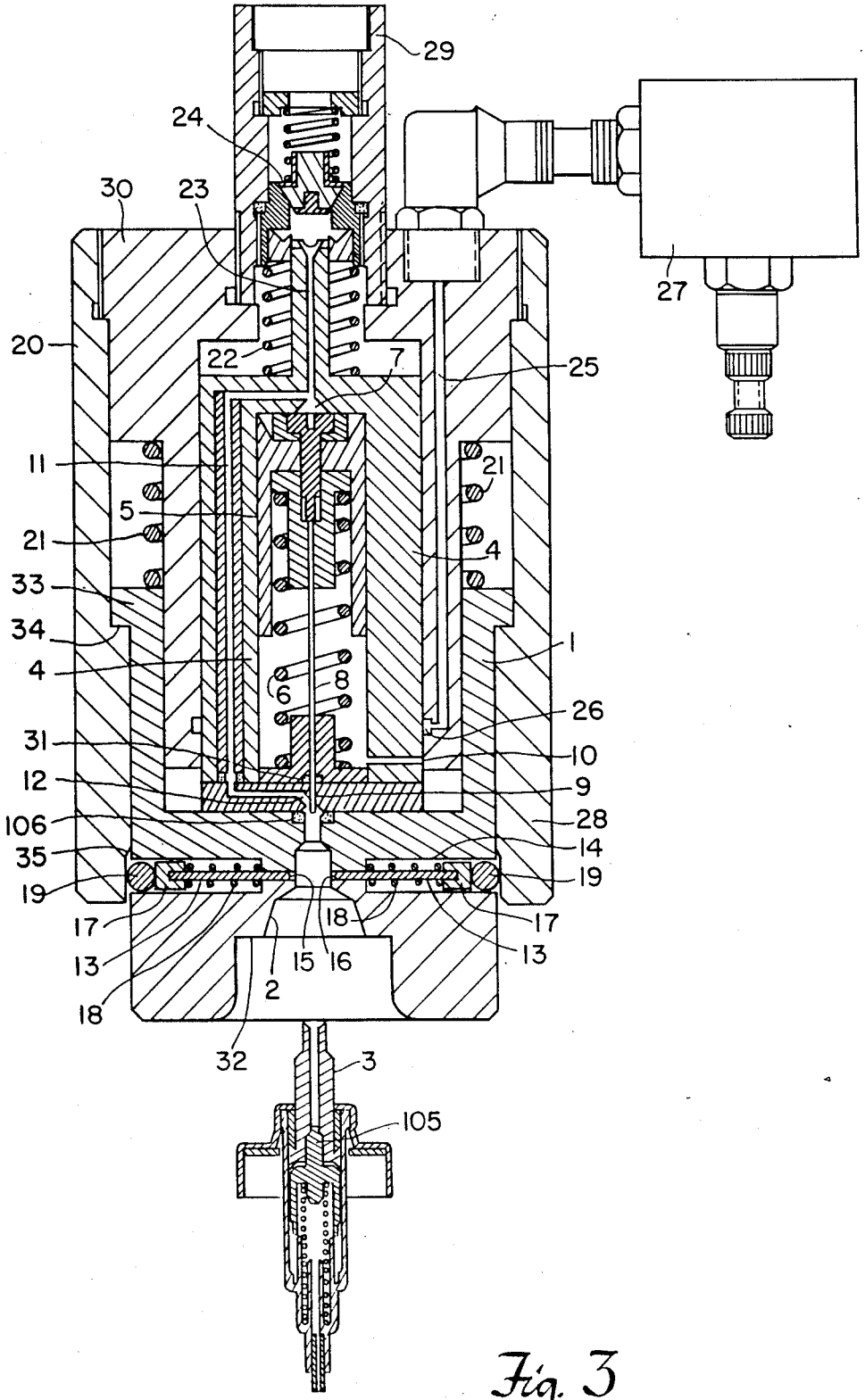
FIG. 3 is a section view through an embodiment of the invention showing the device at rest.

The device operates as follows: a can or flask 100 is filled with liquid up to a certain level in order to leave a volume (e.g. of nitrogen) and it is provided with a pump 3 which is crimped to the receptacle. This receptacle is then placed in the filling position 101 beneath a device 102 in accordance with the invention while the device is in its high position (FIG. 1). When the device is in its high position, its socket is in its low position relative to the sleeve. The valve 24 is thus closed. Gas pressure extends only into the top of the valve body 29. The piston is in its high position inside the cylinder and the needle 8 is retracted so as not to project externally: i.e. the needle is protected and cannot be bent (see FIG. 3).

An actuator (not shown) lowers the device until the shoulder 32 of the centering device 2 comes into abutment against the pump 3. The socket then ceases to move down and slightly compresses the sealing ring 106 in order to provide sealing between the cylinder 4, the socket 1, and the piston of the pump 3, while the actuator continues to lower the sleeve 20, thereby compressing the springs 21 and 22 (which may, for example, offer a resistance of about 5 kg to 10 kg).

Figure 7:
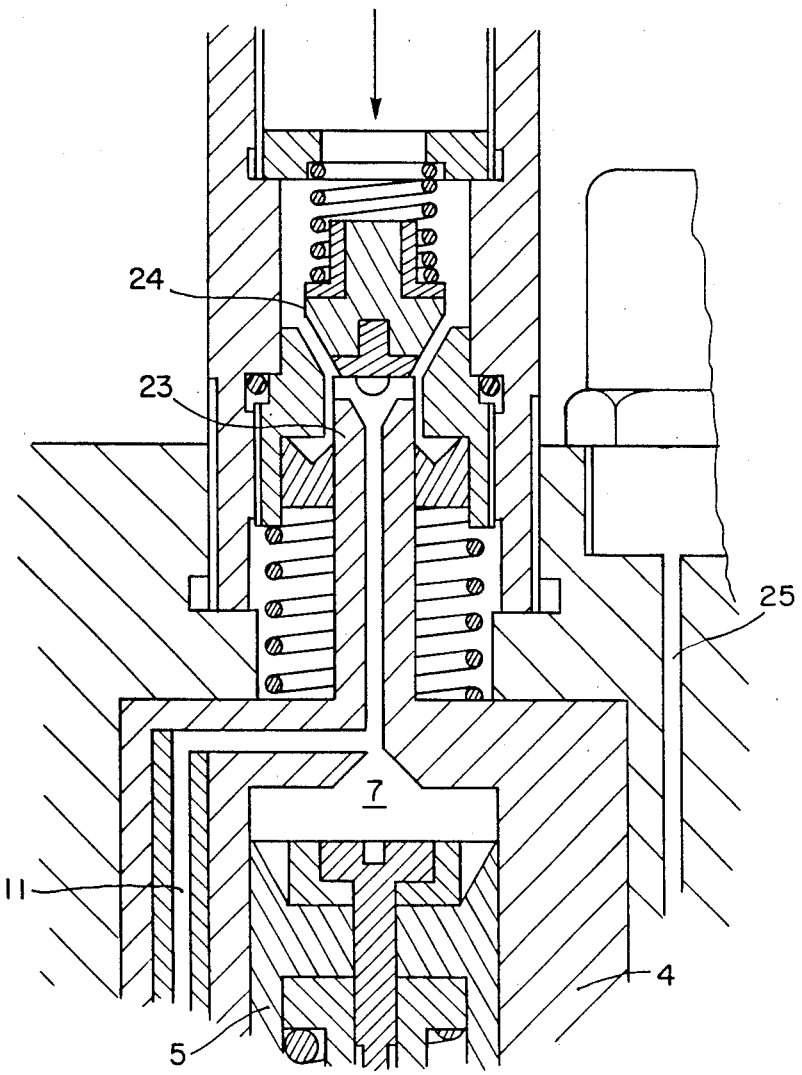
FIG. 7 is a fragmentary section of another detail showing stage No. 3, i.e. the opening of the non-return valve and the passage of gas into the cylinder and the transfer channel.
Figure 8:
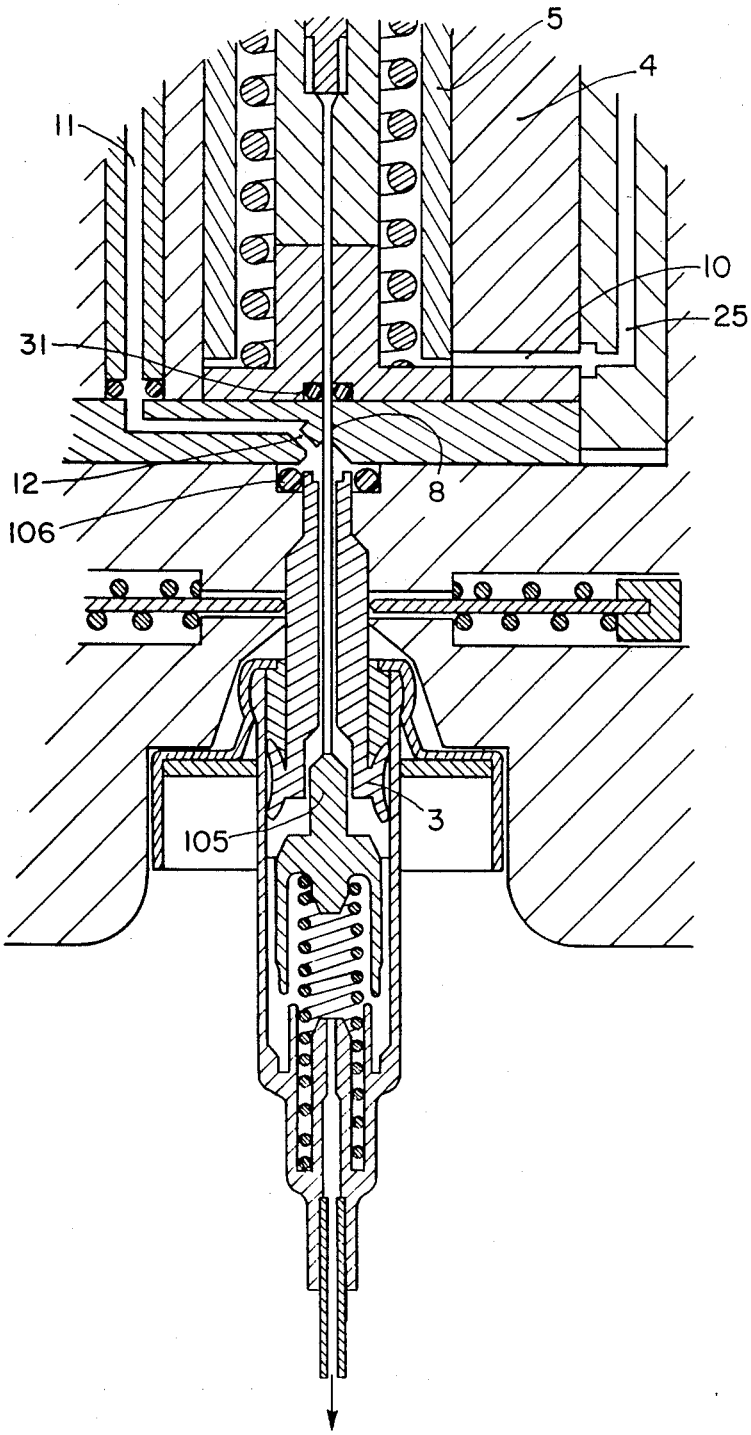
FIG. 8 is a fragmentary section of another detail showing stage No. 4, i.e. the lowering of the needle into the piston of the pump for the purpose of opening the pump's non-return valve and causing gas to pass therethrough.

The continued downward movement of the sleeve 20 causes the socket to be clamped to the piston of the pump by virtue of the tips of the fingers 13 penetrating into the centering device 2, and it also causes the valve 24 to be opened (see FIG. 7) while simultaneously bringing the exhaust 10 from the cylinder 4 into alignment with the duct 25 (see FIG. 8).

Figure 2:
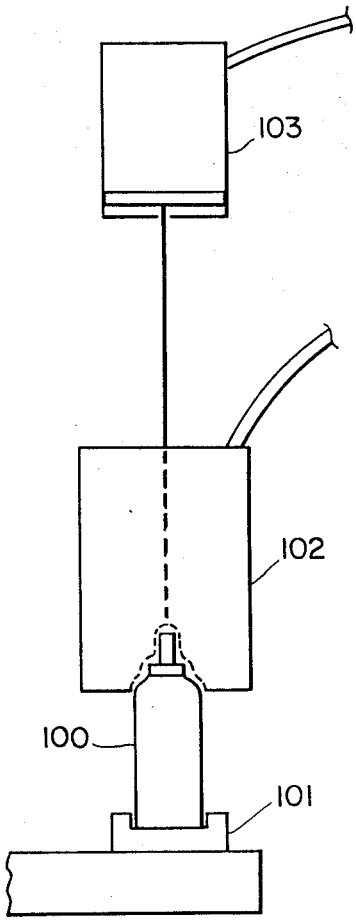
FIG. 2 is a view similar to FIG. 1 during the filling operation.
Figure 4:
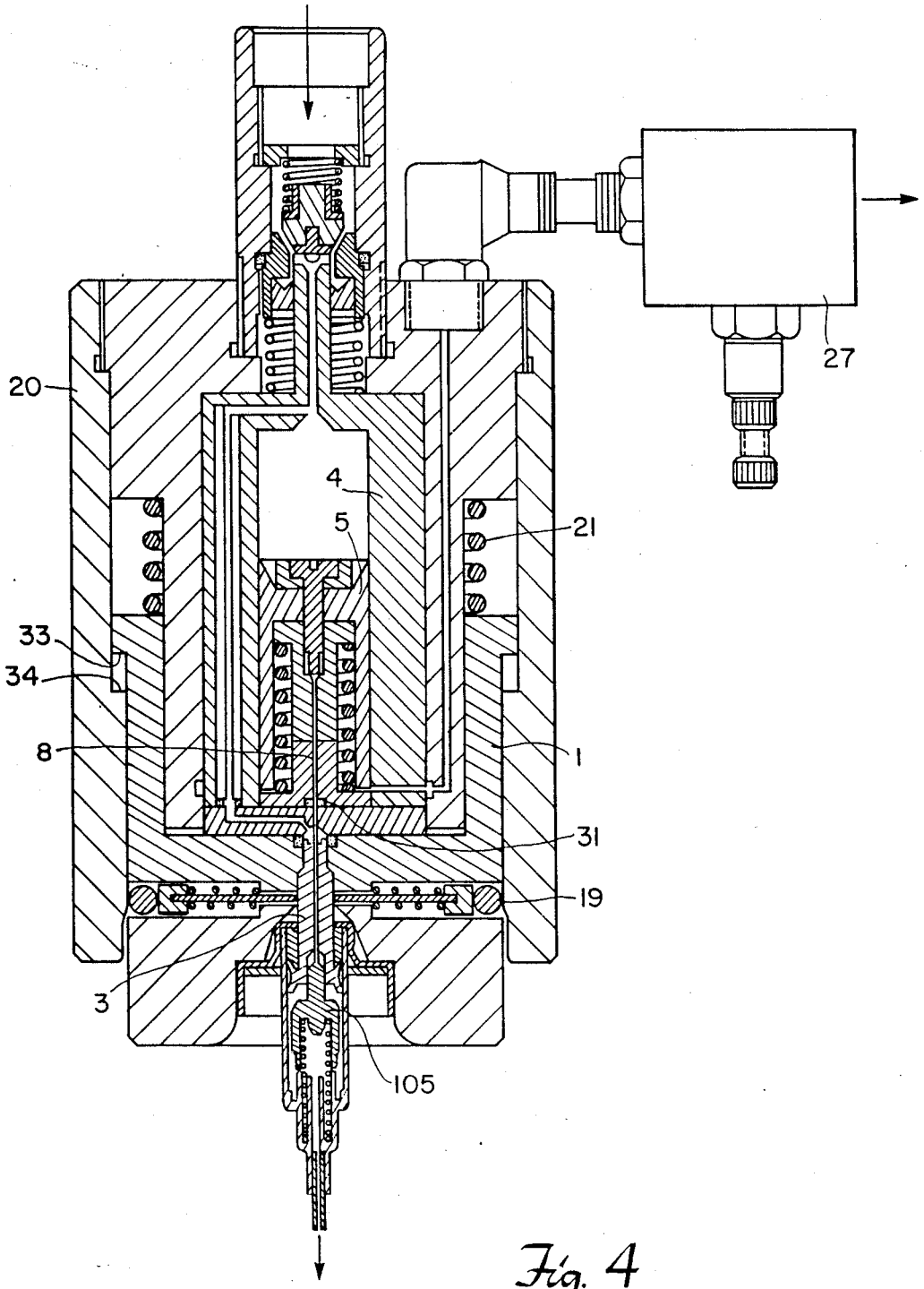
FIG. 4 is a section through the FIG. 3 embodiment showing the device in operation while inserting gas into a sprayer.

The piston 5 therefore moves down and its speed is limited by the throttle 27. The needle 8 therefore moves down at a controlled speed through the bore of the piston rod of the pump 3 and pushes down the valve member 105 which closes said pump. Simultaneously, the gas under pressure passes along the channel 11 and reaches the pump in order to fill it. The relative displacement between the sleeve and the socket also causes the actuator 103 to stop moving down. Thus, when the device is in the position shown in FIG. 2, it is in the state shown in FIG. 4. Gas filling may be stopped by monitoring the pressure in the feed duct, by observing when pressures reach equilbrium, by the filling machine cursor cylinder reaching the end of its stroke, or merely by a time delay. For example, depending on the size of the flask or can, and depending on the desired pressure, gas filling will be terminated after 1 to 3 seconds have elapsed. The actuator is then raised. Initially the sleeve 20 rises on its own, thereby switching off the application of gas pressure by closing the valve 24. Then, when the step 34 comes into abutment against the shoulder 33 on the socket the socket itself is raised and moved by the sleeve. After coming to rest in the high position, and after replacing the can filled with gas by a can which has not yet been filled, the cycle can be restarted.

The device is operated by the pressure of the filling gas arriving via the valve body 24. The damping system ensures uniform operation and avoids accidents.

I claim:

1. A valving device for filling an aerosol can with fluid, where the can has a pump including a non-return valve crimped to the can, the device comprising:

a cylinder means having a central bore, a fluid admission orifice opening into said bore, a fluid outlet orifice, a fluid transfer channel to allow fluid to flow from said admission orifice to said outlet orifice, and an exhaust orifice opening into said bore;

a piston, slidably situated in said bore and slidable between a retracted piston position and an extended piston position;

a needle, carried by said piston, said needle extending through said cylinder means and being adapted to open the non-return valve in the pump of the can when said piston is in said extended piston position; and throttle means for limiting the escape of fluid from said bore through said exhaust orifice when said piston slides into said extended piston position, for damping the sliding motion of said piston and controlling the descent of said needle.

2. The valving device of claim 1 in which said throttle means includes an adapter partly and slidably surrounding said cylinder means, said cylinder means sliding between an extended cylinder position and a retracted cylinder position within said adapter, said adapter adapted to seal off said exhaust orifice when said cylinder is in said extended cylinder position;

said adapter having a relief duct which cooperates with said exhaust orifice when said cylinder is in said retracted cylinder position for allowing fluid to exit said bore when said piston moves toward said extended piston position; and said throttle means further includes a fluid flow limiter operatively coupled to said relief duct to selectively limit the rate at which fluid flows from said bore as said piston moves toward said extended piston position.

3. The valving device of claim 2 in which said adapter includes valve means to control the flow of fluid into said fluid admission orifice and in which said cylinder means is adapted to open said valve means when said cylinder means is in said retracted cylinder position.

4. The valving device of claim 1 further including means for clamping the pump and the device during filling.

5. The valving device of claim 4 in which said means for clamping includes laterally disposed fingers capable of projecting radially inward toward said pump.

* * * * *